US009693606B2

(12) United States Patent
Lee

(10) Patent No.: US 9,693,606 B2
(45) Date of Patent: Jul. 4, 2017

(54) SLIDER ASSEMBLY AND ZIPPER COMPRISING SAME

(71) Applicant: Ok-kyung Lee, Namyangju-si (KR)

(72) Inventor: Ok-kyung Lee, Namyangju-si (KR)

(73) Assignee: KMK Zipper Co., Ltd., Gyeonggi-do (KR)

( * ) Notice: Subject to any disclaimer, the term of this patent is extended or adjusted under 35 U.S.C. 154(b) by 36 days.

(21) Appl. No.: 14/758,703

(22) PCT Filed: Dec. 31, 2013

(86) PCT No.: PCT/KR2013/012439

§ 371 (c)(1),
(2) Date: Jun. 30, 2015

(87) PCT Pub. No.: WO2014/104865

PCT Pub. Date: Sep. 3, 2014

(65) Prior Publication Data

US 2015/0351502 A1 Dec. 10, 2015

(30) Foreign Application Priority Data

Dec. 31, 2012 (JP) ..... 10-2012-0158548

(51) Int. Cl.
*A44B 19/36* (2006.01)
*A44B 19/30* (2006.01)
(Continued)

(52) U.S. Cl.
CPC ..... *A44B 19/36* (2013.01); *A44B 19/02* (2013.01); *A44B 19/30* (2013.01); *A44B 19/38* (2013.01); *Y10T 24/2513* (2015.01)

(58) Field of Classification Search
CPC ..... Y10T 24/2593; Y10T 24/2516; Y10T 24/2513; Y10T 24/2595; Y10T 24/2596;
(Continued)

(56) References Cited

U.S. PATENT DOCUMENTS 1,704,579 A * 3/1929 Sanford ..... A44B 19/38 24/390
2,573,058 A * 10/1951 Rabinow ..... A44B 19/386 24/435
(Continued)

FOREIGN PATENT DOCUMENTS

KR 10-2008-0016477 2/2008
KR 10-1196382 B1 11/2012

*Primary Examiner* — Robert J Sandy
*Assistant Examiner* — Rowland Do
(74) *Attorney, Agent, or Firm* — Woodard, Emhardt, Moriarty, McNett & Henry LLP

(57) ABSTRACT

A slider assembly includes: a slider comprising upper and lower plates provided with teeth guides, and a post connecting the upper and lower plates, the slider interlocking the teeth while advancing along the teeth arranged a set distance apart on each sides of first and second tapes; and separating the teeth while moving backwards therealong; a locking unit, disposed at the longitudinal-direction end of the first tape, for restricting the backward movement of the slider; and a bottom unit, disposed at the longitudinal-direction end of the second tape, elastically coupling with the locking unit by the vertical pressure (in the direction of the thickness of the tape) applied by the overlapping locking unit pressing down, and uncoupling therefrom by the force of moving the slider backwards. The slider assembly can be included in a zipper.

15 Claims, 10 Drawing Sheets

(51) Int. Cl.
*A44B 19/02* (2006.01)
*A44B 19/38* (2006.01)

(58) Field of Classification Search
CPC ..... A44B 19/36; A44B 19/30; A44B 19/02; A44B 19/26; A44B 19/38; A44B 19/388
See application file for complete search history.

(56) References Cited

U.S. PATENT DOCUMENTS 3,775,812 A * 12/1973 Carver, Jr. ..... A44B 19/38 24/390
4,139,927 A * 2/1979 Heimberger ..... A44B 19/38 24/434
4,326,319 A 4/1982 Friedberg
5,272,793 A * 12/1993 Wilk ..... A44B 19/388 24/388
5,333,362 A * 8/1994 Gillioz ..... A44B 19/26 24/433
5,396,685 A * 3/1995 Wilk ..... A44B 19/38 24/388
5,653,002 A 8/1997 Ishihara
6,088,888 A * 7/2000 Oda ..... A44B 19/38 24/433
6,421,887 B1 * 7/2002 Oda ..... A44B 19/38 24/433
6,604,262 B2 * 8/2003 Wang ..... A44B 19/14 24/388
6,826,810 B2 * 12/2004 Ichikawa ..... A44B 19/388 24/381
7,036,192 B2 * 5/2006 Yoneoka ..... A44B 19/38 24/303
9,027,210 B2 * 5/2015 Peters ..... A44B 99/00 24/303
2003/0033695 A1 2/2003 Wang
2008/0040901 A1 2/2008 Himi
2010/0313387 A1 * 12/2010 Peters ..... A44B 19/38 24/381
2013/0205549 A1 8/2013 Lee

* cited by examiner

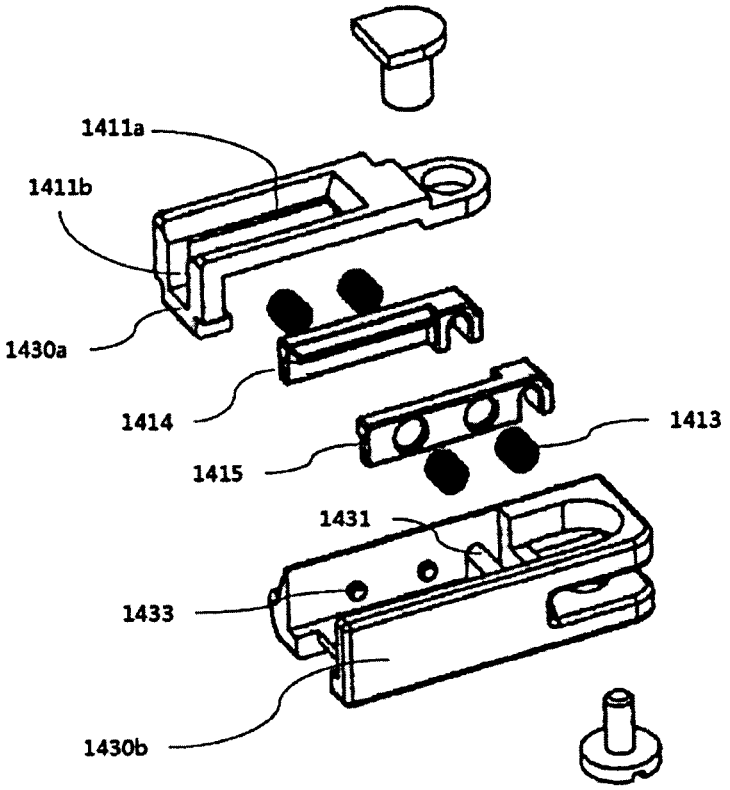
fig 12
fig 13
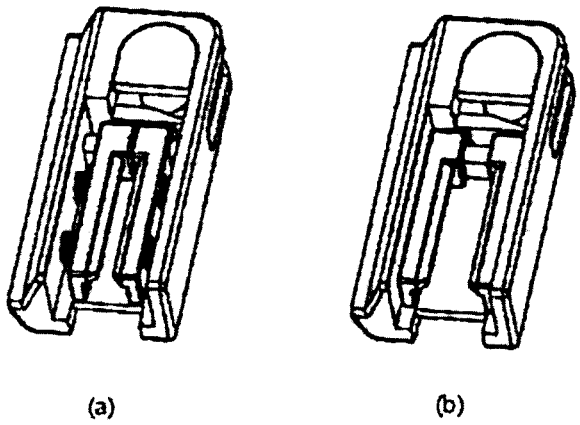

SLIDER ASSEMBLY AND ZIPPER COMPRISING SAME

REFERENCE TO RELATED APPLICATIONS

This application is a National Stage of International Application No. PCT/KR2013/012439, filed Dec. 31, 2013 which claims the benefit of Korean Patent Application No 10-2012-0158548, filed Dec. 31, 2012, each of which is hereby incorporated by reference.

TECHNICAL FIELD

The present invention relates to a slider assembly and a zipper comprising the same.

BACKGROUND ART

Generally, a zipper is installed in a bag or clothing to open and close an inlet and is widely used due to its easy way to open and close.

The structure of a conventional zipper can be simply defined as follows. Teeth are disposed at regular interval at the opposing sides of a pair of fabric tapes, respectively, and a slider with a structure in which the front and rear sides communicate with each other is coupled to one of the tapes.

When the slider is moved forward, the teeth at both sides enter through the front side of the slider to be engaged with each other in the slider and then exit through the rear side. On the contrary, when the slider is moved backward, the teeth being engaged with each other enter through the rear side of the slider to be disengaged from each other in the slider and then exit through the front side, respectively.

However, this conventional zipper has a problem in that the fastening operation is inconvenient. That is in order to fasten the zipper, a bottom stop insertion pin at an end of the tape, to which the slider is not coupled, should be inserted through the slider into a bottom stop box, and when a user wears gloves, for example, it is difficult for the user to insert the insertion pin into the bottom stop box.

A new concept of a slider assembly for solving the above problem is disclosed in Korean Patent Application No 2012-0014943 by the present applicant. This slider assembly has an advantage in that both tapes can be quickly engaged with each other by pressing a bottom stop and a locking unit in an up and down manner, which provides reliable and easy engagement and disengagement of the teeth.

However, this slider assembly requires a slider of a new structure which has a cylindrical shape with an opened bottom and in which both edges to be coupled to teeth are bent inward. Moreover, it requires teeth each having a new structure for accommodating the slider, i.e., teeth each having a specific structure in which an attachment part has a "C" shaped space, in which the edge of the slider is accommodated, and a coupling protrusion for fixing the tape is formed at the bottom of the attachment part.

Therefore, the existing slider and teeth cannot be used, and thus it is necessary to build new equipment for manufacturing the slider and teeth, which increases the initial investment in equipment.

Moreover, these teeth have such problems that the process of coupling to the tape is complicated and restrictive, which increases the overall production costs, and the standardization and optimization of each component requires a lot of time and effort.

In order to overcome these drawbacks, an object of the present invention is to provide a slider assembly of a new structure which can quickly and easily engage and disengage teeth with a simple operation. Moreover, another object of the present invention is to provide a slider assembly which requires low initial investment in equipment, leads to low production costs, and is advantageous for standardization and optimization of components.

To accomplish the above objects, a slider assembly in accordance with an embodiment of the present invention comprises: a slider which comprises upper and lower plates which are provided with teeth guides and a pillar which connects the upper plate and the lower plate, the slider moving forward along teeth arranged at regular intervals on sides of first and second tapes, respectively, to engage the teeth with each other and moving backward to disengage the teeth from each other; a locking unit which is disposed at the first tape and limits the backward movement of the slider; and a bottom unit which is disposed at the second tape, elastically coupled to the locking unit by a force that presses the bottom unit and the locking unit in an up and down manner (in the thickness direction of the tape), and separated from the locking unit by a force that moves the slider backward.

According to an embodiment of the present invention, one of the locking unit and the bottom unit may comprise a coupling protrusion which is formed to protrude from an opposing surface and the other comprises a protrusion receiving portion to which the coupling protrusion is elastically inserted and coupled by a force that presses the bottom unit and the locking unit in an up and down manner.

According to an embodiment of the present invention, at least one of the coupling protrusion and the protrusion receiving portion may comprise an elastic body, the elastic body being elastically deformed by the insertion of the coupling protrusion and confining the coupling protrusion in the protrusion receiving portion by its elastic restoration force such that the coupling protrusion is prevented from being upwardly or downwardly separated from the protrusion receiving portion.

According to an embodiment of the present invention, the elastic body may be elastically deformed by the pressure of the backward moving slider to release the confinement of the coupling protrusion such that the coupling protrusion is upwardly or downwardly separated from the protrusion receiving portion.

According to an embodiment of the present invention, the protrusion receiving portion may comprise: a through hole into which the coupling protrusion is inserted; an elastic body; and a shutter which is coupled to the elastic body, moves in a direction that opens the through hole during the elastic deformation of the elastic body such that the coupling protrusion can be inserted into and separated from the through hole, and moves in a direction that at least partially closes the through hole during the elastic restoration of the elastic body such that the coupling protrusion is confined in the through hole.

According to an embodiment of the present invention, the protrusion receiving portion may comprise an elastic body, the elastic body comprising an elastic coupling hole which is elastically deformed by the pressure of the coupling protrusion that is inserted therein and confines the coupling protrusion therein by its elastic restoration force such that the coupling protrusion is prevented from being upwardly or downwardly separated from the protrusion receiving portion.

According to an embodiment of the present invention, the elastic coupling hole may have an oval shape and may be configured such that the length of a minor axis increases during the elastic deformation such that the coupling protrusion can be inserted into and separated from the elastic coupling hole and the length of the minor axis decreases during the elastic restoration such that the inserted coupling protrusion is confined therein.

According to an embodiment of the present invention, the elastic coupling hole may have a polygonal shape whose width in one direction is short and whose width in the other direction is elongated such that the width in one direction increases during the elastic deformation such that the coupling protrusion can be inserted into and separated from the elastic coupling hole and the width in the other direction decreases during the elastic restoration such that the inserted coupling protrusion is confined therein.

According to an embodiment of the present invention, the protrusion receiving portion may comprise a through hole which at least partially opens a surface opposite to the coupling protrusion such that the coupling protrusion can be inserted into the protrusion receiving portion, the through hole extending to a longitudinal end of the tape such that the coupling protrusion inserted and coupled to the protrusion receiving portion slides in the longitudinal direction of the tape by the pressure of the backward moving slider to exit to the outside through the end.

According to an embodiment of the present invention, the contact surfaces between the bottom unit and the locking unit may have corresponding shapes.

According to an embodiment of the present invention, at least one of the locking unit and the bottom unit may comprise a guide member which guides a position where the locking unit and the bottom unit are coupled to each other.

According to an embodiment of the present invention, the coupling protrusion may comprise: a head which protrudes toward the protrusion receiving portion; and a support which supports the head and has a width smaller than that of the head, and a locking projection may be formed between the head and the support due to the difference in the width.

According to an embodiment of the present invention, the head may have a hemispherical or conical shape, whose width gradually decreases toward the protrusion receiving portion.

To accomplish the above objects, a zipper in accordance with an embodiment of the present invention comprises: first and second tapes which are provided with teeth arranged at regular intervals on their sides; a slider which moves forward along the teeth of the first and second tapes to engage the teeth with each other and move backward to disengage the teeth from each other; a locking unit which is disposed at a longitudinal end of the first tape and limits the backward movement of the slider; and a bottom unit which is disposed at a longitudinal end of the second tape and coupled to the locking unit, and the locking unit and the bottom unit may be elastically coupled to each other in a direction substantially perpendicular to the movement plane of the slider and separated from each other by the pressure of the backward moving slider.

According to the slider assembly of the present invention, it is possible to quickly and easily engage both tapes with a simple operation that presses the bottom unit and the locking unit in an up and down manner.

Moreover, it is possible to quickly and easily disengage both tapes with a simple operation that lowers the slider.

Furthermore, with the use of a slider and teeth having the same shapes as the existing slider and teeth, it is possible to minimize the initial investment in equipment, reduce the production costs, and facilitate the standardization and optimization of each component.

DESCRIPTION OF DRAWINGS

The drawings described below are for illustration purposes only and are not intended to limit the scope of the present invention, in which:

FIG. 12 is an exploded perspective view showing a portion of the bottom unit of FIG. 9 in detail;

FIG. 13 is a perspective view showing a portion of the bottom unit of FIG. 9 in detail;

DESCRIPTION OF PREFERRED EMBODIMENTS

Figure 1:
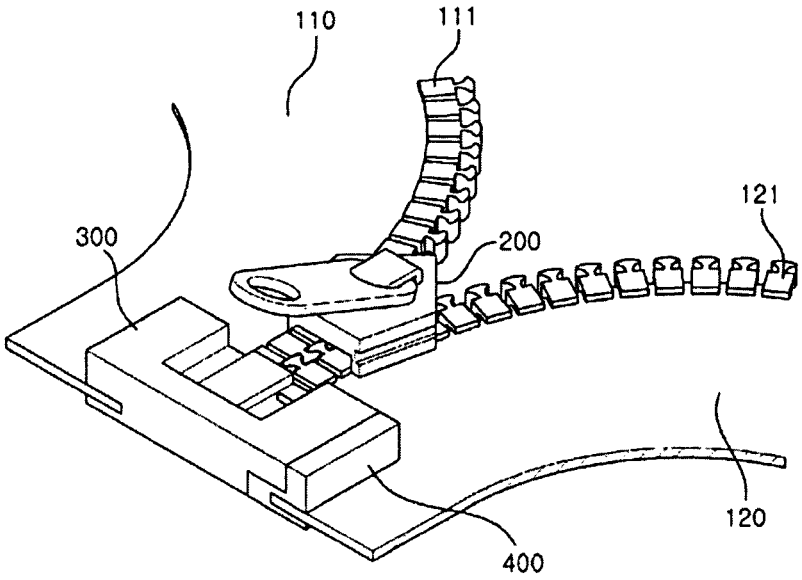
FIG. 1 is a perspective view schematically show mg a zipper comprising a slider assembly in accordance with an embodiment of the present invention.

Hereinafter, preferred embodiments of the present invention will be described in detail with reference to the accompanying drawings. Advantages and features of the present invention and methods of accomplishing the same will become apparent by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

The terms used in the present application are merely used to describe particular embodiments, and are not intended to limit the present invention. As used herein, the singular forms are intended to include the plural forms as well, unless the context clearly indicates otherwise. The terms "comprises" and/or "comprising" used in this specification do not preclude the presence or addition of one or more other components, steps, and/or operations in addition to stated components, steps, and/or operations. Moreover, since the reference numerals are used in the preferred embodiments, the reference numerals presented in the order of description are not necessarily limited to the order.

Moreover, the embodiments of the invention will be described herein with reference to perspective views and cross-sectional views that are schematic illustrations of idealized embodiments of the invention. In the drawings, the dimensions of members and regions are exaggerated for clarity of illustration. As such, variations from the shapes of the illustrations as a result, for example, of manufacturing techniques and/or tolerances, are to be expected. Thus, the embodiments of the invention should not be construed as limited to the particular shapes illustrated herein but are to include deviations in shapes that result, for example, from manufacturing. For example, a region illustrated as a rectangle may be rounded or have a predetermined curvature. Therefore, the members illustrated in the drawings have schematic properties, and the shapes of the members illustrated in the drawings are illustrative of specific shapes of a slider assembly and a zipper and are not intended to limit the scope of the present invention.

First, the structure of a slider assembly in accordance with an embodiment of the present invention will be described with reference to the accompanying drawings.

Figure 2:
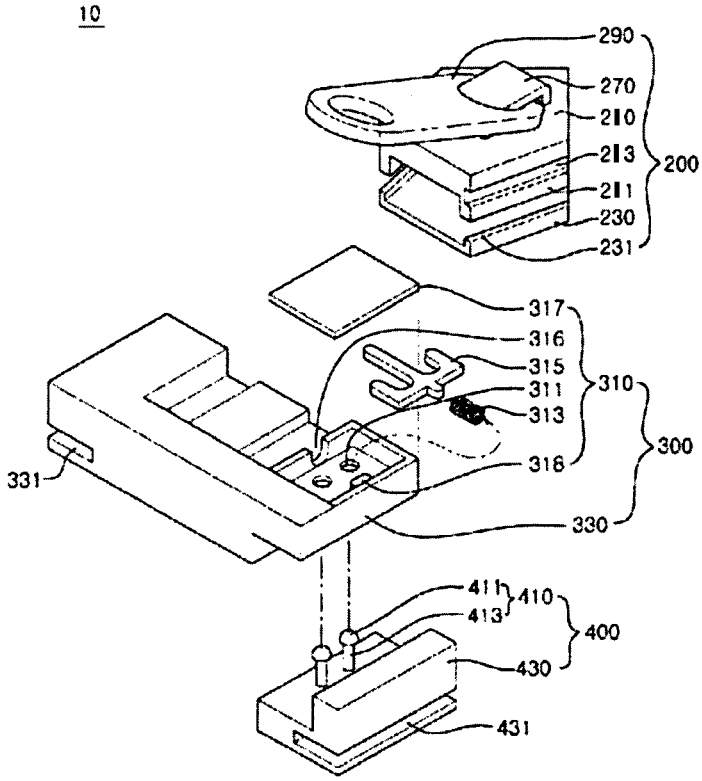
FIG. 2 is an exploded perspective view showing the slider assembly of FIG. 1.

FIG. 1 is a perspective view schematically showing a zipper comprising a slider assembly in accordance with an embodiment of the present invention, and FIG. 2 is an exploded perspective view showing the slider assembly of FIG. 1. Referring to FIGS. 1 and 2, a slider assembly 10 comprises a slider 200, a locking unit 300, and a bottom unit 400.

The slider 200 comprises an upper plate 210 provided with a pair of teeth guides 211 formed downward, a lower plate 230 provided with a pair of teeth guides 231 formed upward, a pillar 250 connecting the upper plate 210 and the lower plate 230, a tap holder 270 fixed to the upper side of the upper plate, and a pull tap 290 inserted into the tap holder to enable the pulling of the slider.

The slider 200 moves forward along teeth 111 and 121, which are arranged at regular intervals on both sides in the width direction of a first tape 110 and a second tape 120, respectively, to engage the teeth 111 and 121 with each other and moves backward to disengage the teeth 111 and 121 from each other.

More specifically, when the slider 200 in which the locking unit 300 and the bottom unit 400 are coupled to each other is pulled in a direction that is away from the locking unit 300 to move forward, the teeth 111 and 121 enter the slider 200 through the area defined by the upper plate 210, the lower plate 230, and the pillar 250 in the front side of the slider 200. The teeth 111 and 121 enter the slider 200 are engaged with each other in the slider 200. Then, the engaged teeth 111 and 121 exit to the outside of the slider 200 through the area defined by the upper plate 210 and the lower plate 230 in the rear side of the slider 200. On the contrary, when the slider 200 is pulled toward the locking unit 300 to move backward, the teeth 111 and 121 enter through the rear side of the slider 200 to be disengaged from each other and then exit through the front side of the slider 200. Here, the expression that the slider moves forward indicates that the slider 200 moves in a direction that is away from the locking unit 300 to engage the teeth 111 and 121 with each other, and the expression that the slider moves backward indicates that the slider 200 moves toward the locking unit 300 to disengage the teeth 111 and 121 from each other.

The shape and structure of the slider 200 are well known in the art, and its detailed description will be omitted.

The locking unit 300 is disposed at the longitudinal end of the first tape 110 and limits the backward movement of the slider 200. The locking unit 300 comprises a protrusion receiving portion 310 and a locking unit body 330.

The protrusion receiving portion 310 comprises a through hole 311, an elastic body 313, a shutter 315, a protrusion 318, an intermediate hole 316, and a cover 317. One or more through holes 311 are formed on the bottom side of the protrusion receiving portion 310, and a coupling protrusion 410 which will be described later is inserted therein. One end of the elastic body 313 is coupled to the protrusion 318 protruding from the wall of the locking unit 300, and the other end is coupled to the shutter 315. The shutter 315 is located at the top of the through hole 311 and configured to at least partially close the through hole 311 in a state where the elastic body 313 is not deformed.

When the shutter 315 is moved backward toward the elastic body 313 by an external force, the elastic body 313 is elastically contraction-deformed, and the through hole 311 is opened. When the external force is removed, the elastic body 313 is elastically restored such that the shutter 315 moves forward toward the intermediate hole 316 to at least partially close the through hole 311. At this time, when the coupling protrusion 410 is being inserted into the through hole 311, the shutter 315 presses the coupling protrusion 410 in a forward direction by the elastic, restoration force of the elastic body 313 such that the coupling protrusion 410 is forcibly inserted into the through hole 311. The front end of the shutter 315 penetrates the intermediate hole 316 and extends to the outside of the locking unit 300. Accordingly, when the slider 200 moves backward and presses the front end of the shutter 315, the shutter 315 elastically contraction-deforms the elastic body 313 and moves backward to open the through hole 311, and as a result, the coupling protrusion 410 forcibly inserted into the through hole 311 can be separated downward from the through hole 311.

Referring to FIG. 2, the protrusion receiving portion 310 is located, at the side of the locking unit 300, and an inclined side channel 213 is formed on the side of the upper plate 210 of the slider 200. Therefore, as the slider 200 moves backward, the side channel 213 presses the front end of the shutter 315 such that the shutter 315 moves backward toward the elastic body 313. Depending on the pressure method of the slider 200, the locations and shapes of the protrusion receiving portion 310, the shutter 315, and the slider 200 can be configured in various ways. For example, when the protrusion receiving portion 310 is not located at the side of the locking unit 300, but located at the rear end, i.e., the backward end of the slider 200, the shutter 315 may extend toward the forward direction of the slider 200, and at this time, the rear side of the slider 200 or the pillar 250 may be configured to press the front end of the shutter 315 to open the through hole 311.

The locking unit body 330 may be formed integrally with the above-mentioned protrusion receiving portion 310 or may be coupled to the protrusion receiving portion 310 as a separate member and comprises a first tape receiving portion 331, a pair of upper rails 333, and a pair of lower rails 335. The first tape receiving portion 331 receives and combines the first tape 110 such that the locking unit 300 is located at the longitudinal end of the first tape 110. The upper rails 333 and the lower rails 335 receive the teeth guides 211 and 231 of the slider 200, respectively, to limit the backward movement of the slider 200.

The bottom unit 400 is disposed at the longitudinal end of the second tape 120 and coupled to the locking unit 300 in an up and down manner, i.e., elastically coupled to the surfaces of the first and second tapes 110 and 120 in the vertical direction. The bottom unit 400 comprises the coupling protrusion 410 and a bottom unit body 430.

The coupling protrusion 410 comprises a support 413 which vertically protrudes from the upper side of the bottom unit body 430 and a head 411 which has a width greater than that of the support 413 and vertically protrudes from the top of the support 413, and a locking projection 415 is formed at the boundary between the support 413 and the head 411 due to the difference in the width. The coupling protrusion 410 is inserted into the protrusion receiving portion 310 through the through hole 311 of the locking unit 300 and forcibly inserted into the through hole 311 under the pressure from the shutter 315 by the elastic restoration force of the elastic body 313, thereby coupling the bottom unit 400 and the locking unit 300 with each other.

The head 411 has a hemispherical or conical shape, whose width increases downward, and the locking projection 415, whose width sharply decreases as described above, is formed therebelow. During the insertion into the through hole 311, the hemisphere- or cone-shaped head 411 slowly presses the shutter 315 to enable smooth backward movement, and during the elastic restoration of the elastic body 313, the locking projection 415 is locked by the upper side of the shutter 315 or the upper side of the through hole 311, thereby preventing the separation of the coupling protrusion 410. Although the head 411 having a hemispherical or conical shape has been described in the foregoing, various shapes of the shutter 315 and the head 411, which enable the smooth backward movement of the shutter 315 upon pressure, are also available. For example, the smooth backward movement of the shutter 315 can be achieved by a combination of a rod-shaped head 411 and a shutter 315 having an inclined plane.

The bottom unit body 430 serves as a support of the coupling protrusion 410 and, at the same time, comprises a second tape receiving portion 431 to receive and combine the second tape 120 such that the bottom unit 400 is located at the longitudinal end of the second tape 120. The contact surfaces between the bottom unit 400 and the locking unit 300 have corresponding shapes, and thus when the bottom unit 400 and the locking unit 300 are in close contact with each other to be combined, the bottom unit 400 and the locking unit 300 guide the coupling protrusion 410 to be inserted into an accurate position of the through hole 311. Moreover, a guide member that guides the coupling protrusion 410 to be inserted into an accurate position of the through hole 311 may be further added to the locking unit 300 or the bottom unit 400.

In the following, the coupling of the slider assembly 10 having the above-described structure will be described.

Figure 3:
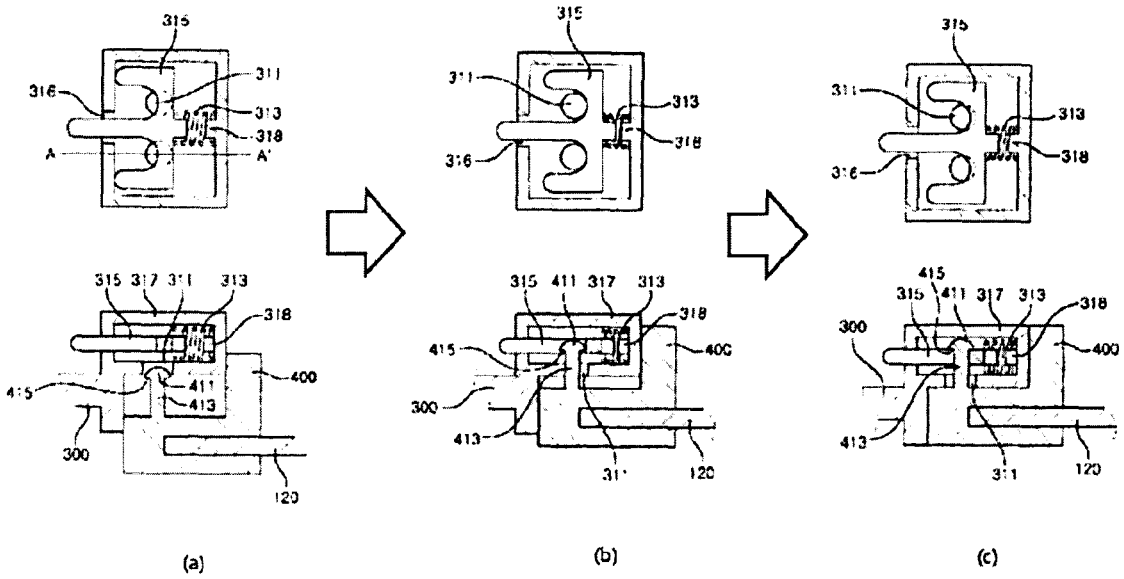
FIG. 3 is a view showing an elastic coupling between a locking unit and a bottom unit of FIG. 1.

FIG. 3 is a view showing an elastic coupling between the locking unit 300 and the bottom unit 400 of FIG. 1, in which the lower figures are partial cross-sectional views cut along line A-A' shown in the upper figures.

Referring to FIG. 3(*a*), as the bottom unit 400 is brought into close contact with the bottom of the locking unit 300, the coupling protrusion 410 is located below the through hole 311 and raised. At this time, since the contact surfaces between the bottom unit 400 and the locking unit 300 have corresponding shapes, the coupling protrusion 410 is guided to be accurately positioned below the through hole 311. Moreover, the head 411 of the coupling protrusion 410 has a width smaller than that of the through hole 311 and thus smoothly passes through the through hole 311.

Referring to FIG. 3(*b*), as the head 411 is further raised, it is in contact with the shutter 315 that at least partially close the through hole 311. Since the head 411 has a hemispherical or conical shape, whose width increases downward, as the head 411 is raised, the shutter 315 slides along the front end slope of the head 411 and is pushed toward the elastic body 313, and thus the elastic body 313 is elastically contraction-deformed.

Referring to FIG. 3(*c*), when the locking projection 415 passes through the upper side of the shutter 315 as the head 411 is further raised, the width of the coupling projection 410 sharply decreases. Accordingly, as the shutter 315 rapidly moves forward by the elastic restoration force of the contraction-deformed elastic body 313, the locking projection 415 is locked by the upper side of the shutter 315, and as a result, the coupling protrusion 410 is inserted and fixed to the protrusion receiving portion 310, thereby coupling the bottom unit 400 and the locking unit 300.

In this state, when the slider 200 moves forward in a direction that is away from the locking unit 300, the first and second teeth 111 and 121 arranged on the sides of the first and second tapes 110 and 120 enter the slider 200 to be engaged with each other in the slider 200 and then exit through the rear side of the slider 200, thereby fastening the zipper.

In the following, the separation of the slider assembly 10 having the above-described structure will be described.

Figure 4:
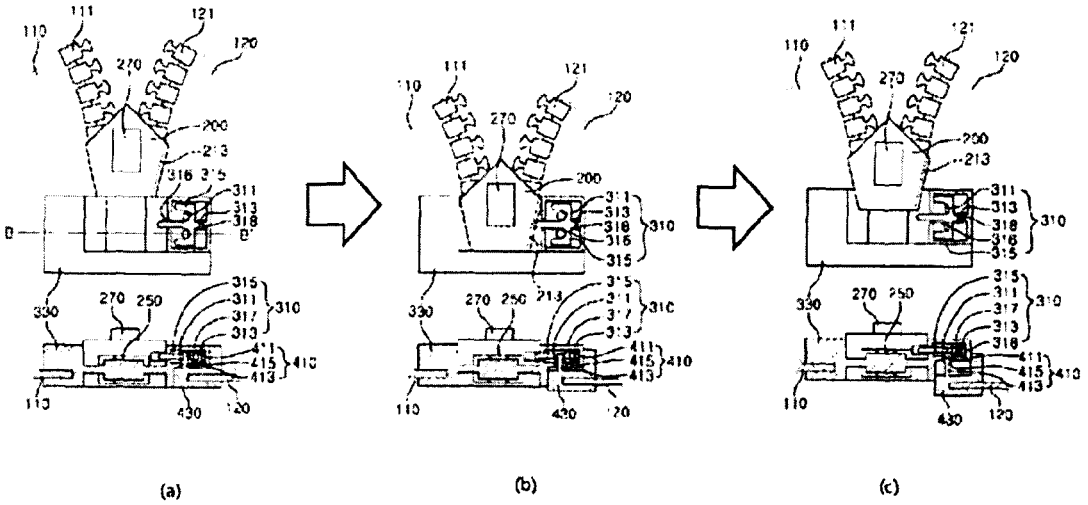
FIG. 4 is a view showing that the elastic coupling between the locking unit and the bottom unit of FIG. 1 is released by a slider.

FIG. 4 is a view showing that the elastic coupling between the locking unit 300 and the bottom unit 400 of FIG. 1 is released by the slider 200, in which the lower figures are partial cross-sectional views cut along line B-B' shown in the upper figures.

Referring to FIG. 4(*a*), when the slider 200 moves backward toward the locking unit 300 while the coupling protrusion 410 is inserted and fixed to the protrusion receiving portion 310, the first and second teeth 111 and 121 being engaged with each other enter through the rear side of the slider 200 to be disengaged from each other in the slider 200 by the pillar 250 and then exit through the front side of the slider 200, respectively.

Referring to FIG. 4(*b*), as the slider 200 further moves backward, the front end of the shutter 315 is brought into contact with the slider 200. More specifically in the shown embodiment, the front end of the shutter 315 is brought into contact with the side channel 213 formed to be inclined on the side of the upper plate 210 of the slider 200. When the slider 200 further moves backward, the shutter 315 is further pushed backward, and the through hole 311 is opened together with the contraction deformation of the elastic body 313. As the through hole 311 is opened, the coupling protrusion 410 is released from the through hole 311 and thus separated downward from the through hole 311.

Referring to FIG. 4(*c*), when the force that moves the slider 200 backward is removed while the coupling protrusion 410 is completely separated downward from the through hole 311, the elastic body 313 is elastically restored, and as a result, the shutter 315 moves forward again to at least partially close the through hole 311. Therefore, the separation of the zipper by the separation of the locking unit 300 and the bottom unit 400 is completed.

In the following, the structure of a slider assembly in accordance with another embodiment of the present invention will be described.

Figure 5:
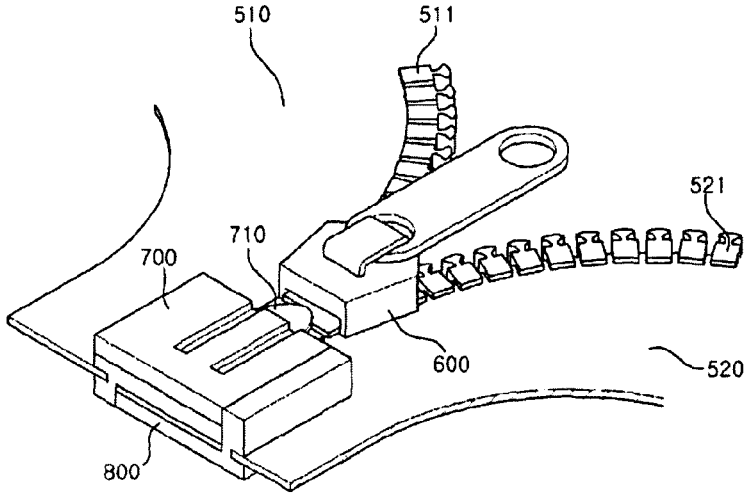
FIG. 5 is a perspective view schematically showing a zipper composing a slider assembly in accordance with another embodiment of the present invention.
Figure 6:
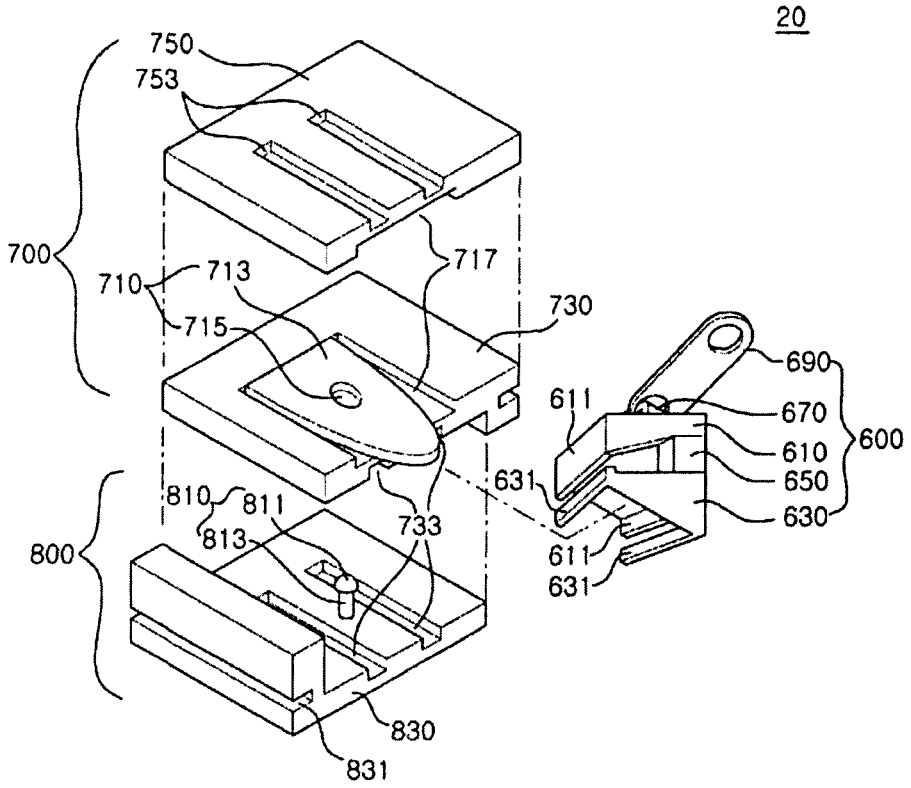
FIG. 6 is an exploded perspective view showing the slider assembly of FIG. 5.

FIG. 5 is a perspective view schematically showing a zipper comprising a slider assembly in accordance with another embodiment of the present invention, and FIG. 6 is an exploded perspective view showing the slider assembly of FIG. 5.

Referring to FIGS. 5 and 6, a slider assembly 20 comprises a slider 600, a locking unit 700, and a bottom unit 800.

The slider 600 comprises an upper plate 610, a lower plate 630, a pillar 650, a tap holder 670, and a pull tap 690. Although the lower plate 630 is shown in the form of a partially opened plate, the lower plate 630 may be in the form of a single plate depending on the combination with the locking unit 700. The shape and structure of the slider 600 are similar to those of the slider 200 described in the previous embodiment, and thus its detailed description will be omitted as it is well known in the art.

The locking unit 700 is disposed at the longitudinal end of a first tape 510 and limits the backward movement of the slider 600. The locking unit 700 comprises a locking unit body 730, a locking unit cover 750, and a protrusion receiving portion 710.

The locking unit body 730 comprises a through hole 711 (see FIG. 7) and a first tape receiving portion 731. One or more through holes 711 are formed below the protrusion receiving portion 710, and a coupling protrusion 810 which will be described later is inserted therein. The first tape receiving portion 731 receives and combines the first tape 510 such that the locking unit 700 is located at the longitudinal end of the first tape 510. Lower rails 733, which receive a pair of teeth guides 631 formed upward from the lower plate 630 and limit the backward movement of the slider 600, is provided between the locking unit body 730 and the bottom unit 800, and a receiving box 717 which receives the protrusion receiving portion 710 is provided between the locking unit body 730 and the locking unit cover 750.

The locking unit cover 750 comprises upper rails 753 which receive a pair of teeth guides 611 formed downward from the upper plate 610 and limit the backward movement of the slider 600.

The protrusion receiving portion 710 comprises an elastic body 713 which is located inside the receiving box 717 and whose one end projects to the outside of the locking unit 700. The elastic, body 713 comprises an elastic coupling hole 715 where the coupling protrusion 810 ran be inserted and separated during the elastic deformation of the elastic body 713 and which can confine the inserted coupling protrusion 810 by the elastic restoration force. The elastic, coupling hole 715 is located above the through hole 711 and configured to at least partially close the through hole 711 in a state where the elastic body 713 is not deformed.

For example, the elastic coupling hole 715 has an oval shape as shown in the figure and is configured such that the length of the major axis of the oval is greater than the diameter of the through hole 711 and the length of the minor axis of the oval is smaller than the diameter of the through hole 711. Since the length of the minor axis of the elastic coupling hole 715 is smaller than the diameter of the through hole 711, the elastic body 713 at least partially closes the through hole 711 in a state where the elastic body 713 is not deformed. Although the elastic coupling hole 715 has been illustrated as having an oval shape, the elastic coupling hole 715 may be formed into various shapes such as a polygon with one long end, etc.

When the one end of the elastic body 713, which projects to the outside of the locking unit 700, is pressed by an external force such as the backward movement of the slider 600, the elastic body 713 is deformed such that the length of the minor axis of the elastic coupling hole 715 increases and the length of the major axis decreases. As such, when the elastic body 713 is elastically deformed, the through hole 711 is opened.

The bottom unit 800 is disposed at the longitudinal end of a second tape 520 and coupled to the locking unit 700 in an up and down manner, i.e. elastically coupled to the surfaces of the first and second tapes 510 and 520 in the vertical direction. The bottom unit 800 comprises the coupling protrusion 810 and a bottom unit body 830.

The coupling protrusion 810 comprises a support 813 which vertically protrudes from the upper side of the bottom unit body 830 and a head 811 which has a width greater than that of the support 813 and vertically protrudes from the top of the support 813, and a locking projection 815 is formed at the boundary between the support 813 and the head 811 due to the difference in the width. The coupling protrusion 810 is inserted into the receiving box 717 through the through hole 711 of the locking unit 700 and the elastic coupling hole 715, and when the minor axis of the elastic coupling hole 715 contracts as the elastic deformation of the elastic body 713 is restored, the coupling protrusion 810 is forcibly inserted into the elastic coupling hole 715 by the elastic restoration force of the elastic body 713, thereby coupling the bottom unit 800 and the locking unit 700 with each other.

The head 811 has a hemispherical or conical shape, whose width increases downward, and the locking projection 815, whose width sharply decreases as described above, is formed therebelow. During the insertion into the elastic coupling hole 715, the hemisphere- or cone-shaped head 811 slowly presses the minor axis of the elastic coupling hole 715 such that the elastic body 713 is elastically deformed to increase the minor axis of the elastic coupling hole 715, and during the elastic restoration of the elastic body 713, the locking projection 815 is locked by the upper side of the elastic body 713, thereby preventing the downward separation of the coupling protrusion 810.

The bottom unit body 830 serves as a support of the coupling protrusion 810 and, at the same time, comprises a second tape receiving portion 831 to receive and combine the second tape 520 such that the bottom unit 800 is located at the longitudinal end of the second tape 520. The contact surfaces between the bottom unit 800 and the locking unit 700 have corresponding shapes, and thus when the bottom unit 800 and the locking unit 700 are in close contact with each other to be combined, the bottom unit 800 and the locking unit 700 guide the coupling protrusion 810 to be inserted into an accurate position of the elastic coupling hole 715. Moreover, a guide member that guides the coupling protrusion 810 to be inserted into an accurate position of the elastic coupling hole 715 may be further added to the locking unit 700 or the bottom unit 800.

In the following, the coupling of the slider assembly 20 having the above-described structure will be described.

Figure 7:
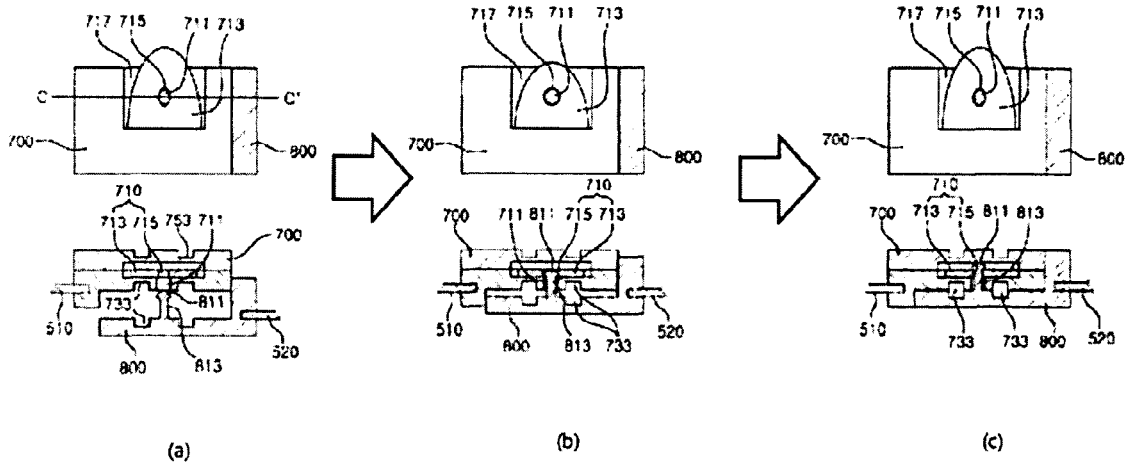
FIG. 7 is a view showing an elastic coupling between a locking unit and a bottom unit of FIG. 5.

FIG. 7 is a view showing an elastic coupling between the locking unit 700 and bottom unit 800 of FIG. 5, in which the lower figures are partial cross-sectional views cut along line C-C' shown in the upper figures.

Referring to FIG. 7(*a*), as the bottom unit 800 is brought into close contact with the bottom of the locking unit 700, the coupling protrusion 810 is located below the through hole 711 and raised. At this time, since the contact surfaces between the bottom unit 800 and the locking unit 700 have corresponding shapes, the coupling protrusion 810 is guided to be accurately positioned below the through hole 711.

Moreover, the head 811 of the coupling protrusion 810 has a width smaller than that of the through hole 711 and thus smoothly passes through the through hole 711.

Referring to FIG. 7(*b*), as the head 811 is further raised, it is in contact with the elastic coupling hole 715 that at least partially closes the through hole 711. Since the head 811 has a hemispherical or conical shape, whose width increases downward, as the head 811 is raised, the minor axis of the elastic coupling hole 715 slides along the front end slope of the head 811 and increases, and thus the elastic body 713 is elastically deformed.

Referring, to FIG. 7(*c*), when the locking projection 815 completely passes through the elastic coupling hole 715 as the head 811 is further raised, the width of the coupling projection 810 sharply decreases. Accordingly, as the minor axis of the elastic coupling hole 715 sharply decreases by the elastic restoration force of the elastic body 713, the locking projection 815 is locked by the upper side of the elastic body 713, and as a result, the coupling protrusion 810 is inserted and fixed to the protrusion receiving portion 710, thereby coupling the bottom unit 800 and the locking unit 700.

In this state, when the slider 600 moves forward in a direction that is away from the locking unit 700, the first and second teeth 511 and 521 arranged on the sides of the first and second tapes 510 and 520 enter the slider 600 to be engaged with each other in the slider 600 and then exit through the rear side of the slider 600, thereby fastening the zipper.

In the following, the separation of the slider assembly 20 having the above-described structure will be described.

Figure 8:
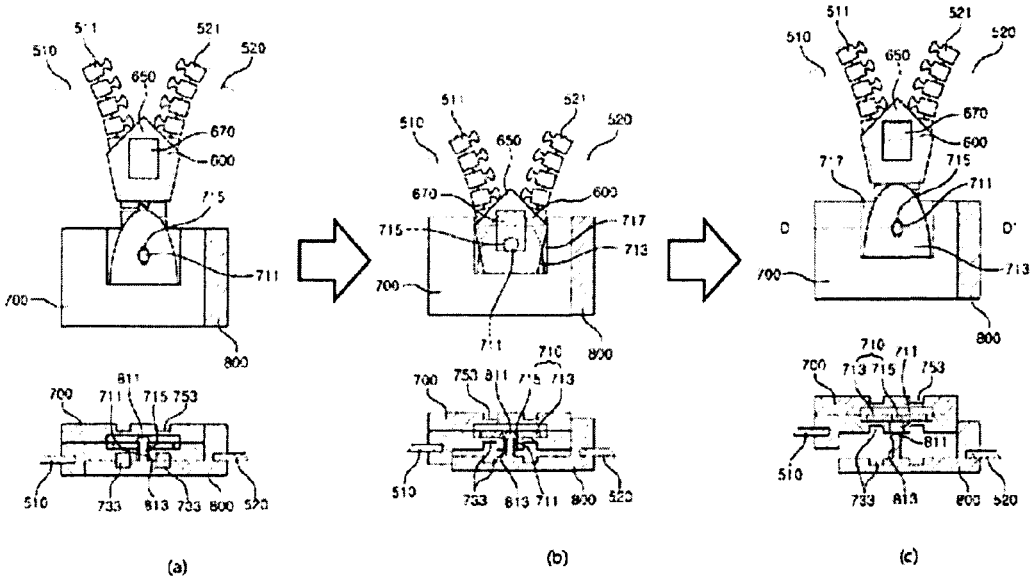
FIG. 8 is a view showing that the elastic coupling between the locking unit and the bottom unit of FIG. 5 is released by a slider.

FIG. 8 is a view showing that the elastic coupling between the locking unit 700 and the bottom unit 800 of FIG. 5 is released by the slider 600, in winch the lower figures are partial cross-sectional views cut along line D-D' shown in the upper figures.

Referring to FIG. 8(*a*), when the slider 600 moves backward toward the locking unit 700 while the coupling protrusion 810 is inserted and fixed to the protrusion receiving portion 710, the first and second teeth 511 and 521 being engaged with each other enter through the rear side of the slider 600 to be disengaged from each other in the slider 600 by the pillar 650 and then exit through the front side of the slider 600, respectively.

Referring to FIG. 8(*b*), as the slider 600 further moves backward, the front end of the elastic body 713 is brought into contact with the slider 600. More specifically, in the shown embodiment, the front end of the elastic body 713 is brought into contact with the pillar 650 of the slider 600. When the slider 600 further moves backward, the elastic body 713 is pressed by the pillar 650 of the slider 600 and deformed, the length of the minor axis of the elastic coupling hole 715 increases, and thus the through hole 711 is opened. Therefore, the coupling protrusion 810 is released from the through hole 711 and thus separated downward from the through hole 711.

Referring to FIG. 8(*c*), when the force that moves the slider 600 backward is removed while the coupling protrusion 810 is completely separated downward from the elastic coupling hole 715, the elastic body 713 is elastically restored, and as a result, the minor axis of the elastic coupling hole 715 decreases again to at least partially close the through hole 711. Therefore, the separation of the zipper by the separation of the locking unit 700 and the bottom unit 800 is completed.

In the above, although the case where the coupling protrusion 810 is fixed or unfixed by the combination of the through hole 711 and the elastic, coupling hole 715 has been described, the coupling protrusion 810 can be fixed or unfixed without the through hole 711 or only by the elastic coupling hole 715 regardless of the through hole 711.

In the following, the structure of a slider assembly in accordance with still another embodiment of the present invention will be described.

Figure 9:
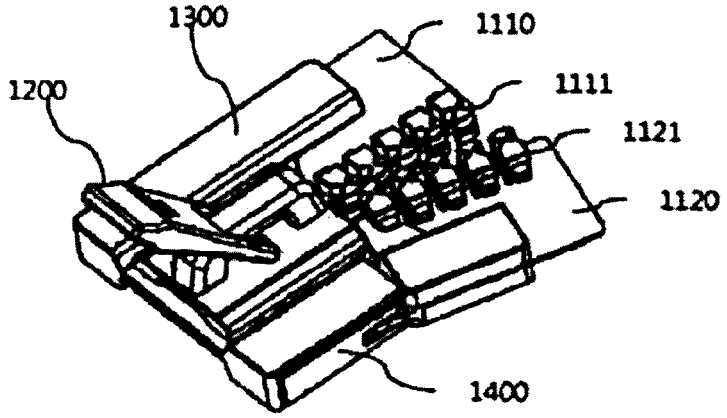
FIG. 9 is a perspective view schematically showing a zipper comprising a slider assembly in accordance with still another embodiment of the present invention.
Figure 10:
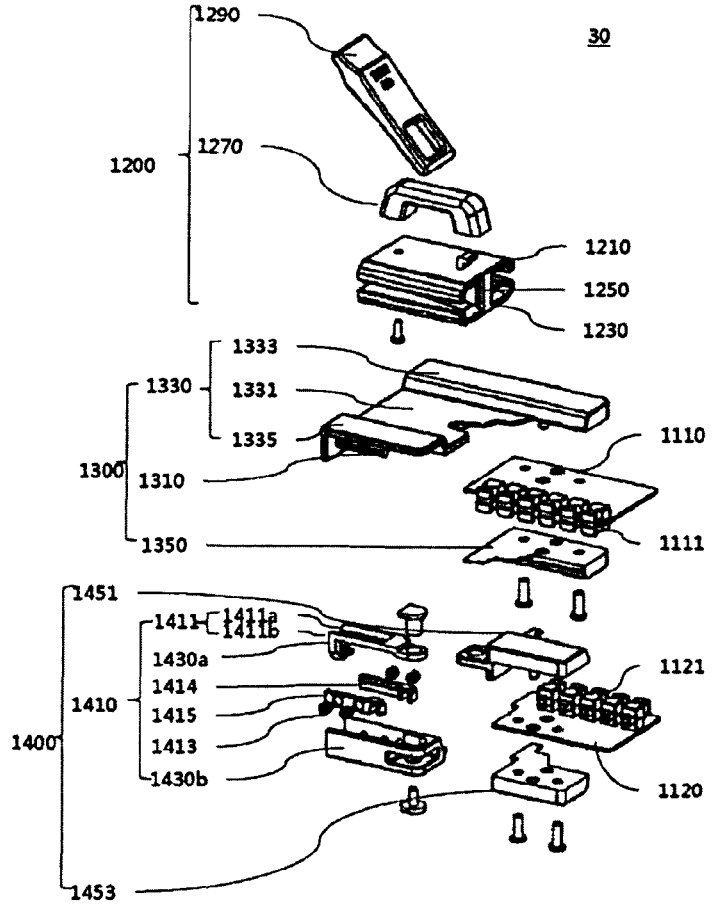
FIG. 10 is an exploded perspective view showing the slider assembly of FIG. 9 together with tapes at both sides.
Figure 11:
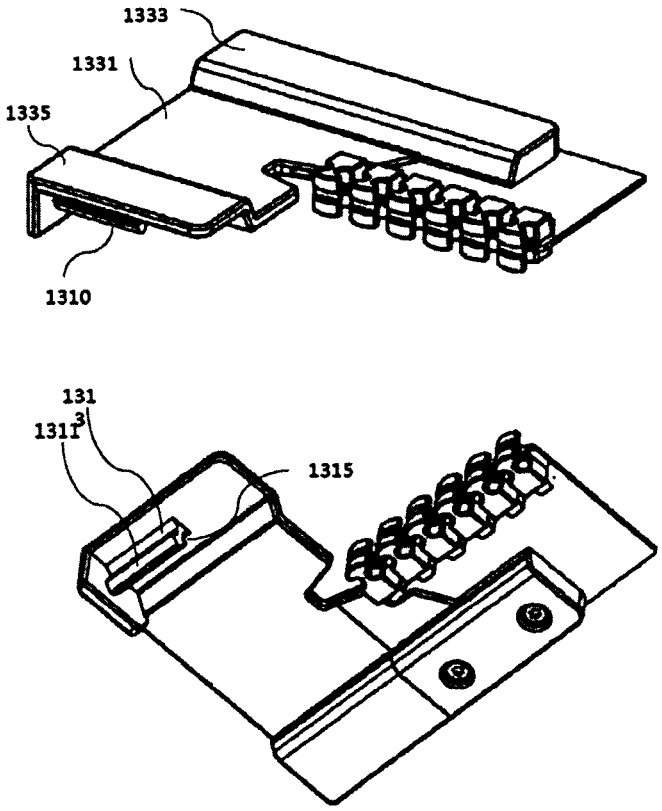
FIG. 11 is a perspective view showing the locking unit of FIG. 9 in detail.

FIG. 9 is a perspective view schematically showing a zipper comprising a slider assembly in accordance with still another embodiment of the present invention, and FIG. 10 is an exploded perspective view showing the slider assembly of FIG. 9 together with tapes at both sides. Moreover, FIG. 11 is a perspective view showing the locking unit of FIG. 9 in detail, FIG. 12 is an exploded perspective view showing a portion of the bottom unit of FIG. 9 in detail, and FIG. 13 is a perspective view showing a portion of the bottom unit of FIG. 9 in detail.

Referring to FIGS. 9 to 13, a slider assembly 30 comprises a slider 1200, a locking unit 1300, and a bottom unit 1400.

The slider 1200 comprises an upper plate 1210, a lower plate 1230, a pillar 1250, a tap holder 1270, and a pull tap 1290. The shape and structure of the slider 1200 are similar to those of the slider 200 described in the previous embodiment, and thus its detailed description will be omitted as it is well known in the art.

The locking unit 1300 is disposed at the longitudinal end of a first tape 1110 and limits the backward movement of the slider 1200. The locking unit 1300 comprises a protrusion receiving portion 1310, a locking unit body 1330, and a first tape coupling portion 1350.

The protrusion receiving portion 1310 comprises a support 1313 which vertically protrudes from the lower side of the locking unit body 1330 and a head 1311 which has a width greater than that of the support 1313 and vertically protrudes from the bottom of the support 1313, and a locking projection 1315 is formed at the boundary between the support 1313 and the head 1311 due to the difference in the width. The protrusion receiving portion 1310 is inserted between a shutter 1414 and a shutter 1415 through an upper opening 1411*a* of a through hole 1411 of the bottom unit 1400, which will be described later. Then, the protrusion receiving portion 1310 is pressed from the shutter 1414 and the shutter 1415 by the elastic restoration three of an elastic, body 1413 connected to the shutter 1414 and the shutter 1415 and inserted and fixed between the shutter 1414 and the shutter 1415, thereby coupling the locking unit 1300 and the bottom unit 1400 with each other.

The head 1311 has a hemispherical or conical shape, whose width increases upward and which is elongated in the longitudinal direction of the tape, and the locking projection 1315, whose width sharply decreases as described above, is formed therebelow. During the insertion into the upper opening 1411*a* of the through hole 1411, the elongated hemisphere- or cone-shaped head 1311 slowly presses the shutters 1414 and 1415 to enable smooth backward movement, and during the elastic restoration of the elastic body 1413, the locking projection 1315 is locked by the lower sides of the shutters 1414 and 1415 or the lower sides of the protrusions of the shutters 1414 and 1415, thereby preventing the upward separation of the coupling protrusion 1310.

The locking unit body 1330 comprises a platform 1331 which receives the slider 1200, a first guide 1333 which guides one side of the slider 1200 and, at the same time, combines with the first tape coupling portion 1350 with the first tape 1110 interposed therebetween such that the locking unit 1300 is located at the longitudinal end of the first tape 1110, and a second guide 1335 which guides the other side of the slider 1200 and, at the same time, serves as a support of the coupling protrusion 1310.

The bottom unit 1400 is disposed at the longitudinal end of a second tape 1120 and coupled to the locking unit 1300 in an up and down manner, i.e., elastically coupled to the surfaces of the first and second tapes 1110 and 1120 in the vertical direction. The bottom unit 1400 comprises a protrusion receiving portion 1410 and a second tape coupling portion 1450.

The protrusion receiving portion 1410 comprises the elastic body 1413, the shutters 1414 and 1415, and an opening body 1430. The opening body 1430 has a box shape, in which an opening cover 1430*a* and an opening base 1430*b* are coupled to each other, and comprises a through hole 1411 with a partially opened upper surface which extends to the longitudinal end surface of the tape (in the backward direction of the slider). That is, the through hole 1411 has a slot shape which comprises the upper opening 1411*a* which at least partially opens the upper surface of the opening body 1430 and an end opening 1411*b* which at least partially opens the longitudinal end surface of the tape in the opening body 1430. Therefore, the coupling protrusion 1310 is inserted downward into the protrusion receiving portion 1410 through the upper opening 1411*a*, slides in the protrusion receiving portion 1410 in the backward direction of the slider 1200 by the force that moves the slider 1200 backward while being confined, in the protrusion receiving portion 1410, and then exits to the outside of the protrusion receiving portion 1410 through the end opening 1411*b*.

The opening body 1430 comprises a guide bar 1431 and a protrusion 1433. One end of the elastic body 1413 is coupled to the protrusion 1433 protruding from the inside of the opening body 1430, and the other end is coupled to the shutters 1414 and 1415. The pair of shutters 1414 and 1415 are located at the bottom of the upper opening 1411*a* and configured to at least partially close the upper opening 1411*a* in a state where the elastic body 1413 is not deformed. The pair of shutters 1414 and 1415 are coupled to the guide bar 1431, for example, and guided. The pair of shutters 1414 and 1415 move backward in a direction that is away from each other during the elastic deformation of the elastic body 1413 and move forward in a direction that is close to each other when the elastic deformation of the elastic body 1413 is restored.

When the shutters 1414 and 1415 move backward toward the elastic body 1413 by an external force, the elastic body 1413 is elastically contraction-deformed, and the upper opening 1411*a* is opened. When the external force is removed, the elastic body 1413 is elastically restored such that the shutters 1414 and 1415 move forward to at least partially close the upper opening 1411*a*. At this time, when the coupling protrusion 1310 is being inserted between the shutters 1414 and 1415, the shutters 1414 and 1415 press the coupling protrusion 1310 in the forward direction by the elastic restoration force of the elastic body 1413 such that the coupling protrusion 1310 is forcibly inserted into the protrusion receiving portion 1410, thereby preventing the upward separation of the coupling protrusion 1310 through the upper opening 1411*a*.

The second tape coupling portion 1450 comprises a second tape cover 1451 and a second tape base 1453 which are coupled to each other with the second tape 1120 interposed therebetween such that the bottom unit 1400 is located at the longitudinal end of the second tape 1120. The second tape coupling portion 1450 may be formed integrally with the protrusion receiving portion 1410 or may be coupled to the protrusion receiving portion 1410 as a separate member.

The contact surfaces between the bottom unit 1400 and the second guide 1335 of the locking unit body 1330 have corresponding shapes, and thus when the bottom unit 1400 and the locking unit 1300 are in close contact with each other to be combined, the bottom unit 1400 and the locking unit body 1330 guide the coupling protrusion 1310 to be inserted into an accurate position of the upper opening 1411*a* of the through hole 1411.

In the following, the coupling of the slider assembly 30 having the above-described structure will be described.

Figure 14:
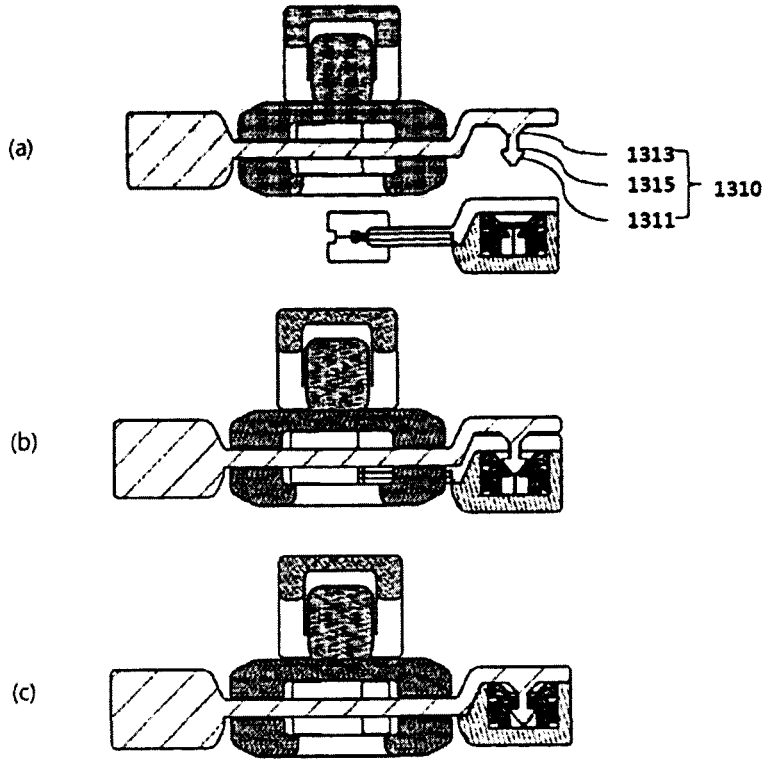
FIG. 14 is a view showing an elastic coupling between the locking unit and the bottom unit of FIG. 9.
Figure 15:
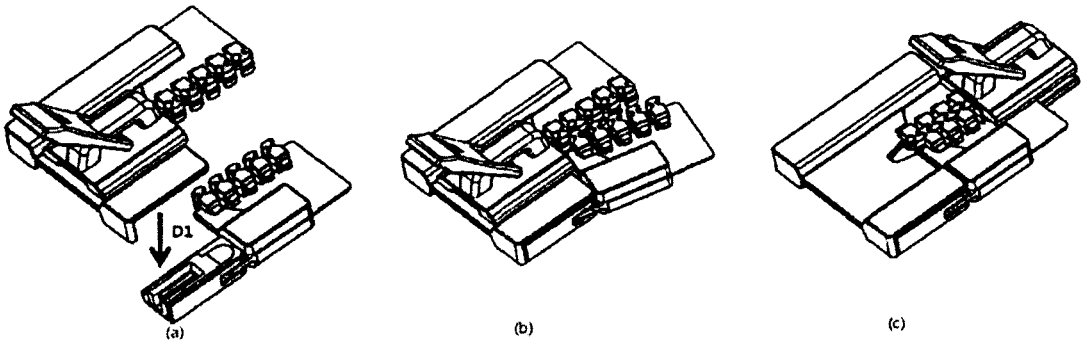
FIG. 15 is a perspective view showing an elastic coupling between the locking unit and the bottom unit of FIG. 9.

FIGS. 14 and 15 show an elastic coupling between the locking unit 1300 and the bottom unit 1400.

Referring to FIGS. 14(*a*) and 15(*a*), as the locking unit 1300 is brought into close contact with the top of the bottom unit 1400 in the vertical direction (in the D1 direction), the coupling protrusion 1310 is located above the upper opening 1411*a* of the through hole 1411 and lowered. At this time, since the contact surfaces between the bottom unit 1400 and the locking unit 1300 have corresponding shapes, the coupling protrusion 1310 is guided to be accurately positioned above the upper opening 1411*a*. Moreover, the head 1311 of the coupling protrusion 1310 has a width smaller than that of the upper opening 1411*a* and thus smoothly passes through the upper opening 1411*a*.

Referring to FIG. 14(*b*), as the head 1311 is further lowered, it is in contact with the shutters 1414 and 1415 that at least partially close the upper opening 1411*a*. Since the head 1311 has a hemispherical or conical shape, whose width increases upward, as the head 1311 is lowered, the shutters 1414 and 1415 slide along the front end slope of the head 1311 and are pushed in a direction that is away from each other, i.e., toward the elastic body 1413, and thus the elastic body 1413 is elastically contraction-deformed.

Referring to FIG. 14(*c*), when the locking projection 1315 passes through the lower sides of the shutters 1414 and 1415 or the lower sides of the projections of the shutters 1414 and 1415 as the head 1311 is further lowered, the width of the coupling projection 1310 sharply decreases. Accordingly, as the shutters 1414 and 1415 are rapidly closer to each other by the elastic restoration force of the contraction-deformed elastic body 1413, the locking projection 1315 is locked by the lower sides of the shutters 1414 and 1415 or the lower sides of the projections of the shutters 1414 and 1415, and as a result, the coupling protrusion 1310 is inserted and fixed to the protrusion receiving portion 1410 to prevent the upward separation of the coupling, protrusion 1310 through the upper opening 1411*a*, thereby coupling the bottom unit 1400 and the locking unit 1300.

In this state, when the slider 1200 moves forward in a direction that is away from the locking unit 1300, the first and second teeth 1111 and 1121 arranged on the sides of the first, and second tapes 1110 and 1120 enter the slider 1200 to be engaged with each other in the slider 1200 and then exit through the rear side of the slider 1200, thereby fastening the zipper.

In the following, the separation of the slider assembly 30 having the above-described structure will be described.

Figure 16:
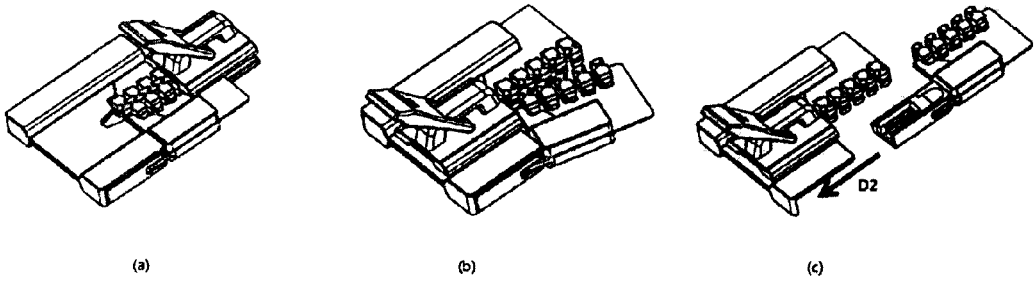
FIG. 16 is a perspective view showing, that the elastic coupling between the locking unit and the bottom unit of FIG. 9 is released by a slider.

FIG. 16 is a perspective view showing that the elastic coupling between the locking unit and the bottom unit of FIG. 9 is released by a slider.

Referring to FIG. 16(*a*), when the slider 1200 moves backward toward the locking unit 1300 while the coupling protrusion 1310 is inserted and fixed to the protrusion receiving portion 1410, the first and second teeth 1111 and 1121 being engaged with each other enter through the rear side of the slider 1200 to the disengaged from each other in the slider 1200 by the pillar 1250 and then exit through the front side of the slider 1200, respectively.

Referring to FIG. 16(*b*), as the slider 1200 further moves backward, the side of the slider 1200 is guided by the first guide 1333 and the second guide 1335 of the locking unit body 1330 and received in the platform 1331.

Referring to FIG. 16(*c*), as the slider 1200 further moves backward, the locking unit 1300 is pushed in the backward direction of the slider 1200. Accordingly, the coupling protrusion 1310, which is prevented from being upwardly separated through the upper opening 1411*a* by the pressure of the shutters 1414 and 1415 and the locking projection 1315, slides between the shutters 1414 and 1415 in the longitudinal direction of the tape (in the D2 direction), and finally exits to the outside of the protrusion receiving portion 1410 through the end opening 1411*b* formed on the longitudinal end surface of the bottom unit 1400. Therefore, the separation of the zipper by the separation of the locking unit 1300 and the bottom unit 1400 is completed.

Figure 17:
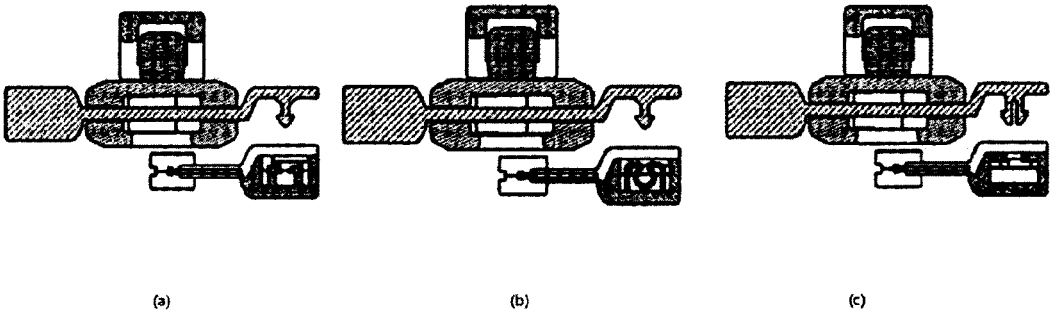
FIG. 17 is cross-sectional views showing various shapes of the locking unit and the bottom unit.

In the above, although the coupling protrusion 1310, which is inserted and coupled between the shutters 1414 and 1415 which are closer to or further away from each other by the elastic body 1413, has been described as an example, the insertion and coupling of the locking unit 1300 and the bottom unit 1400 can be implemented in various ways. For example, the object of the present invention can be achieved by various types of the locking unit and the bottom unit such as the protrusion receiving portion (FIGS. 17(*a*) and 17(*b*)) which can be elastically deformed without the elastic body or the protrusion receiving portion (FIG. 17(*c*)) whose width can be elastically deformed.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

According to the slider assembly of the present invention, it is possible to quickly and easily engage both tapes with a simple operation that presses the bottom unit and the locking unit in an up and down manner. Moreover, it is possible to quickly and easily disengage both tapes with a simple operation that lowers the slider. Furthermore, with the use of a slider and teeth having the same shapes as the existing slider and teeth, it is possible to minimize the initial investment in equipment, reduce the production costs, facilitate the standardization and optimization of each component.

The invention claimed is:

1. A slider assembly comprising:

a slider which comprises upper and lower plates which are provided with teeth guides and a pillar which connects the upper plate and the lower plate, the slider moving forward along teeth arranged at regular intervals on sides of first and second tapes, respectively, to engage the teeth with each other and moving backward to disengage the teeth from each other;

a locking unit which is disposed at the first tape and limits the backward movement of the slider;

a bottom unit which is disposed at the second tape, elastically coupled to the locking unit by a force that presses the bottom unit and the locking unit in an up and down manner in the thickness direction of the tape, and separated from the locking unit by a force that moves the slider backward;

wherein one of the locking unit and the bottom unit comprises a coupling protrusion which is formed to protrude from an opposing surface and the other comprises a protrusion receiving portion to which the coupling protrusion is elastically inserted and coupled by a force that presses the bottom unit and the locking unit in an up and down manner; and wherein the protrusion receiving portion comprises: a through hole into which the coupling protrusion is inserted; an elastic body; and a shutter which is coupled to the elastic body, moves in a direction that opens the through hole during the elastic deformation of the elastic body such that the coupling protrusion can be inserted into and separated from the through hole, and moves in a direction that at least partially closes the through hole during the elastic restoration of the elastic body such that the coupling protrusion is confined in the through hole.

2. The slider assembly of claim 1, wherein at least one of the coupling protrusion and the protrusion receiving portion comprises an elastic body, the elastic body being elastically deformed by the insertion of the coupling protrusion and confining the coupling protrusion in the protrusion receiving portion by its elastic restoration force such that the coupling protrusion is prevented from being upwardly or downwardly separated from the protrusion receiving portion.

3. The slider assembly of claim 2, wherein the elastic body is elastically deformed by the pressure, of the backward moving slider to release the confinement of the coupling protrusion such that the coupling protrusion is upwardly or downwardly separated from the protrusion receiving portion.

4. The slider assembly of claim 1, wherein the contact surfaces between the bottom unit and the locking unit have corresponding shapes.

5. The slider assembly of claim 1, wherein at least one of the locking unit and the bottom unit comprises a guide member which guides a position where the locking unit and the bottom unit are coupled to each other.

6. The slider assembly of claim 1, wherein the coupling protrusion comprises:

a head which protrudes toward the protrusion receiving portion; and a support which supports the head and has a width smaller than that of the head, and wherein a locking projection is formed between the head and the support due to the difference in the width.

7. The slider assembly of claim 6, wherein the head has a hemispherical or conical shape, whose width gradually decreases toward the protrusion receiving portion.

8. A slider assembly comprising:

a slider which comprises upper and lower plates which are provided with teeth guides and a pillar which connects the upper plate and the lower plate, the slider moving forward along teeth arranged at regular intervals on sides of first and second tapes, respectively, to engage the teeth with each other and moving backward to disengage the teeth from each other;

a locking unit which is disposed at the first tape and limits the backward movement of the slider; and a bottom unit which is disposed at the second tape, elastically coupled to the locking unit by a force that presses the bottom unit and the locking unit in an up and down manner in the thickness direction of the tape, and separated from the locking unit by a force that moves the slider backward;

wherein one of the locking unit and the bottom unit comprises a coupling protrusion which is formed to protrude from an opposing surface and the other comprises a protrusion receiving portion to which the coupling protrusion is elastically inserted and coupled by a force that presses the bottom unit and the locking unit in an up and down manner; and wherein the protrusion receiving portion comprises an elastic body, the elastic body comprising an elastic coupling hole which is elastically deformed by the pressure of the coupling protrusion that is inserted therein and confines the coupling protrusion therein by its elastic restoration force such that the coupling protrusion is prevented from being upwardly or downwardly separated from the protrusion receiving portion.

9. The slider assembly of claim 8, wherein the elastic coupling hole has an oval shape and is configured such that the length of a minor axis increases during the elastic deformation such that the coupling protrusion can be inserted into and separated from the elastic coupling hole and the length of the minor axis decreases during the elastic restoration such that the inserted coupling protrusion is confined therein.

10. The slider assembly of claim 8, wherein the elastic coupling hole has a polygonal shape whose width in one direction is short and whose width in the other direction is elongated such that the width in one direction increases during the elastic deformation such that the coupling protrusion can be inserted into and separated from the elastic coupling hole and the width in the other direction decreases during the elastic restoration such that the inserted coupling protrusion is confined therein.

11. The slider assembly of claim 8, wherein the contact surfaces between the bottom unit and the locking unit have corresponding shapes.

12. The slider assembly of claim 8, wherein at least one of the locking unit and the bottom unit comprises a guide member which guides a position where the locking unit and the bottom unit are coupled to each other.

13. A slider assembly comprising:

a slider which comprises upper and lower plates which are provided with teeth guides and a pillar which connects the upper plate and the lower plate, the slider moving forward along teeth arranged at regular intervals on sides of first and second tapes, respectively, to engage the teeth with each other and moving backward to disengage the teeth from each other;

a locking unit which is disposed at the first tape and limits the backward movement of the slider; and a bottom unit which is disposed at the second tape, elastically coupled to the locking unit by a force that presses the bottom unit and the locking unit in an up and down manner in the thickness direction of the tape, and separated from the locking unit by a force that moves the slider backward;

wherein one of the locking unit and the bottom unit comprises a coupling protrusion which is formed to protrude from an opposing surface and the other comprises a protrusion receiving portion to which the coupling protrusion is elastically inserted and coupled by a force that presses the bottom unit and the locking unit in an up and down manner; and wherein the protrusion receiving portion comprises a through hole which at least partially opens a surface opposite to the coupling protrusion such that the coupling protrusion can be inserted into the protrusion receiving portion, the through hole extending to a longitudinal end of the tape such that the coupling protrusion inserted and coupled to the protrusion receiving portion slides in the longitudinal direction of the tape by the pressure of the backward moving slider to exit to the outside through the end.

14. The slider assembly of claim 13, wherein the contact surfaces between the bottom unit and the locking unit have corresponding shapes.

15. The slider assembly of claim 13, wherein at least one of the locking unit and the bottom unit comprises a guide member which guides a position where the locking unit and the bottom unit are coupled to each other.

* * * * *